United States Patent [19]

Mickler

[11] 4,195,562

[45] Apr. 1, 1980

[54] CAN DISINTEGRATING APPARATUS AND METHOD

[76] Inventor: Edwin W. Mickler, P.O. Box 43, Zellwood, Fla. 32798

[21] Appl. No.: 928,834

[22] Filed: Jul. 28, 1978

[51] Int. Cl.[2] ..... B30B 15/08

[52] U.S. Cl. ..... 100/39; 83/331; 100/DIG. 2; 100/97; 100/98 R; 100/100; 100/215; 100/218

[58] Field of Search ..... 100/39, 94, 95, 96, 100/97, 98 R, 210, DIG. 2, 100, 215, 218, 53; 83/331, 150

[56] References Cited

U.S. PATENT DOCUMENTS

| | | | |
|---|---|---|---|
| 1,598,364 | 8/1926 | Cassell | 100/DIG. 2 |
| 1,761,984 | 6/1930 | Frick | 100/DIG. 2 |
| 2,150,984 | 3/1939 | Near | 100/DIG. 2 |
| 2,356,122 | 8/1944 | Edwards | 100/DIG. 2 |
| 2,604,034 | 7/1952 | Hess | 100/98 R |
| 2,808,776 | 10/1957 | Palmer | 100/DIG. 2 |
| 3,036,517 | 5/1962 | Malarsky | 100/DIG. 2 |
| 3,066,600 | 12/1962 | Couty | 100/DIG. 2 |
| 3,682,341 | 8/1972 | Happel | 100/DIG. 2 |
| 3,881,380 | 5/1975 | Paramonoff | 83/150 |
| 4,119,024 | 10/1978 | White | 100/DIG. 2 |

*Primary Examiner*—Billy J. Wilhite

*Attorney, Agent, or Firm*—Duckworth, Hobby, Allen & Pettis

[57] ABSTRACT

An apparatus and method for disintegrating a can includes a feeding chute for feeding the cans into a cutter-compactor mechanism in which cutting blades are fixedly positioned on a rotating drum for cutting each can fed into the mechanism and driving the can further into the compacting portion of the drum. The rotating drum compacts the cans against a fixed arcuate surface and drops the cut and compacted can pieces into a receptacle. The rotating drum has annular raised sides for holding the cans therebetween and protruding cleats on its surface for dragging the cam into the compacting portion. The fixed compacting surface is arcuate to gradually compress the can being pulled against it as the space narrows between the surface and the rotating drum. The chute may have a ferrous can detector to eliminate ferrous cans from the unit, and the fixed compacting surface has a slot to allow the blades to pass therethrough as the drum rotates.

16 Claims, 6 Drawing Figures

CAN DISINTEGRATING APPARATUS AND METHOD

BACKGROUND OF THE INVENTION

The present invention relates to can disintegrators for disintegrating aluminum cans by cutting and compacting the cans and dropping them into a receptacle, whereby the metal may be recycled.

In the past, a great variety of machines have been provided to shred cans or to compact cans to reduce the space the cans take up in storage and shipping for recycling. This becomes more important as the price of aluminum rises. It is also desirable to sort the metal cans so that the aluminum cans are stored separate from ferrous or glass. Many of the prior art machines have been too bulky or expensive for placement at retail outlets where the cans can be easily stored, disintegrated and eventually picked up for recycling.

A typical shredding machine can be seen in U.S. Pat. No. 1,598,364 which has a belt and gear drive for driving a pair of drums rotating adjacent each other, each drum having a plurality of projecting teeth protruding therefrom, so that a can passing between the drums will be shredded into pieces. The Edwards U.S. Pat. No. 2,356,122 shows a crushing machine in which a pair of flattened conical shapes on the side of gears are driven adjacent each other for crushing cans, while in U.S. Pat. No. 2,150,984, a combined crushing and feeding device was provided for a junk shredding machine in which junk metal is fed through a crusher and feeder into a rotating shredding machine which shreds the metal. U.S. Pat. No. 3,881,380 shows a scrap disposal mechanism for metallic can body trimmers and U.S. Pat. No. 3,006,600 flattens cans between a pair of drums. U.S. Pat. No. 3,036,517 crushes cans between arcuate surfaces.

The present invention relates to a combination can cutting and compacting machine which separates out ferrous metal cans and glass, then cuts and compacts aluminum cans and drops them in a storage receptacle for eventual recycling. The machine advantageously is sufficiently compact and simple in operation so that it can be placed at retail outlets to reduce the size of the storage of the aluminum cans for pickup for recycling.

SUMMARY OF THE INVENTION

A can disintegrating apparatus includes a frame having a feed chute attached thereto for feeding cans and having a magnetic separator on the chute to catch ferrous cans being fed in the chute. As each can is fed into the disintegrator it is hit by rotating blades attached to a rotating drum which will cut the can and move it forward for compacting. However, if a glass bottle is dropped in the chute, the blades will break the glass into pieces where they will fall through a grate and thereby be separated from the final aluminum receptacle. The cut can is pulled forward by the blades and by protruding cleats protruding from the drum into an arcuate fixed surface or anvil, where it is compressed as the cut aluminum can feeds into the narrowing portion between the drum surface and the fixed compacting surface. Once the can feeds through the narrowest portion it is dropped into a receptacle where it is stored until picked up for recycling. An electric motor drives the rotating drum which acts as both the cutting and compacting portion of the mechanism, and the fixed anvil surface has a slot therein for the blade to pass through as the drum rotates.

A method of disintegrating cans includes the steps of feeding the cans down a chute and cutting the cans into two or more pieces while feeding the cans into a compactor, then compacting the cans between the drum and a stationary surface and directing the cut and compacted cans into a receptacle. The method includes driving cut cans with cleats while compacting the cans.

BRIEF DESCRIPTION OF THE DRAWINGS

Other objects, features and advantages of the present invention will be apparent from the written description and the drawings, in which.

DESCRIPTION OF THE PREFERRED EMBODIMENT

Figure 1:
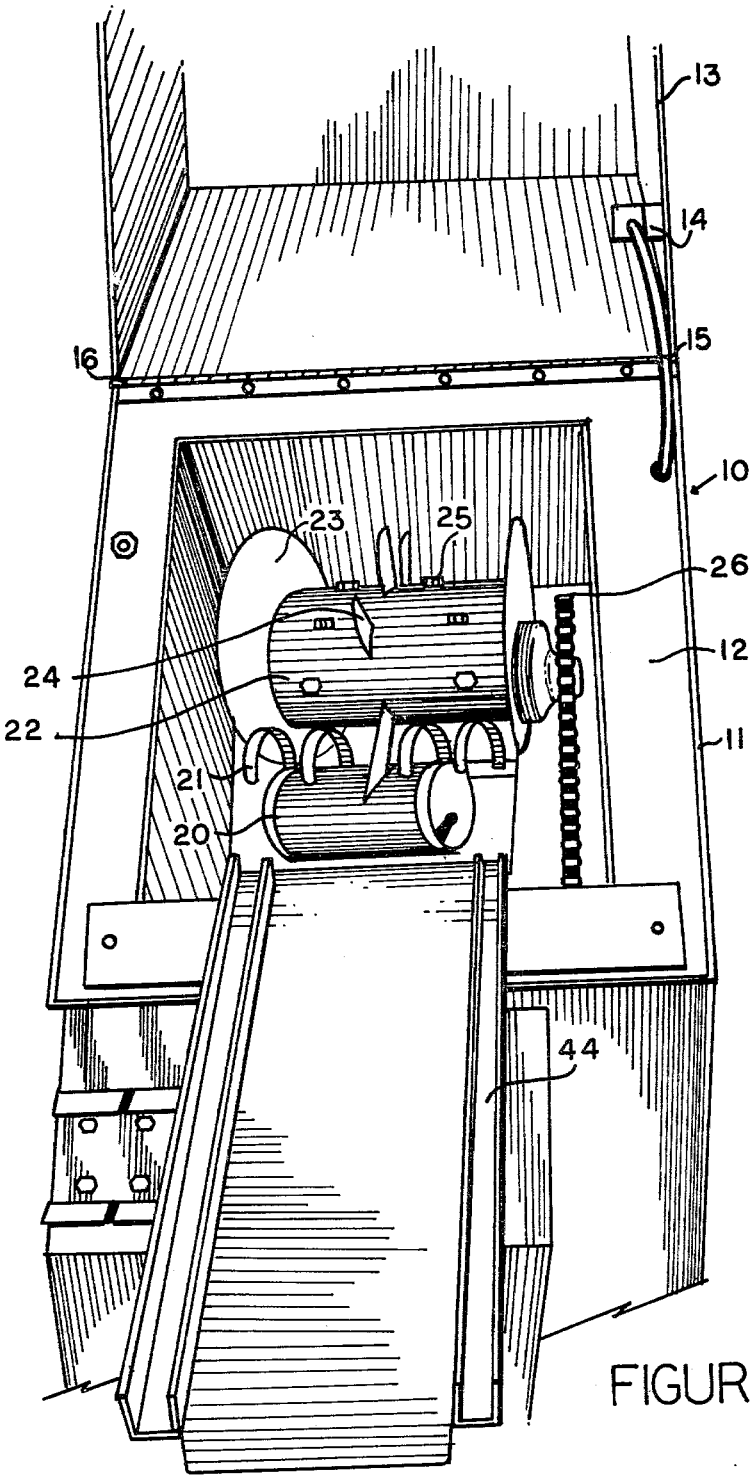
FIG. 1 shows a front perspective view of a can disintegrating machine having the top cover opened for viewing the cutting and compacting drum.
Figures 2, 5:
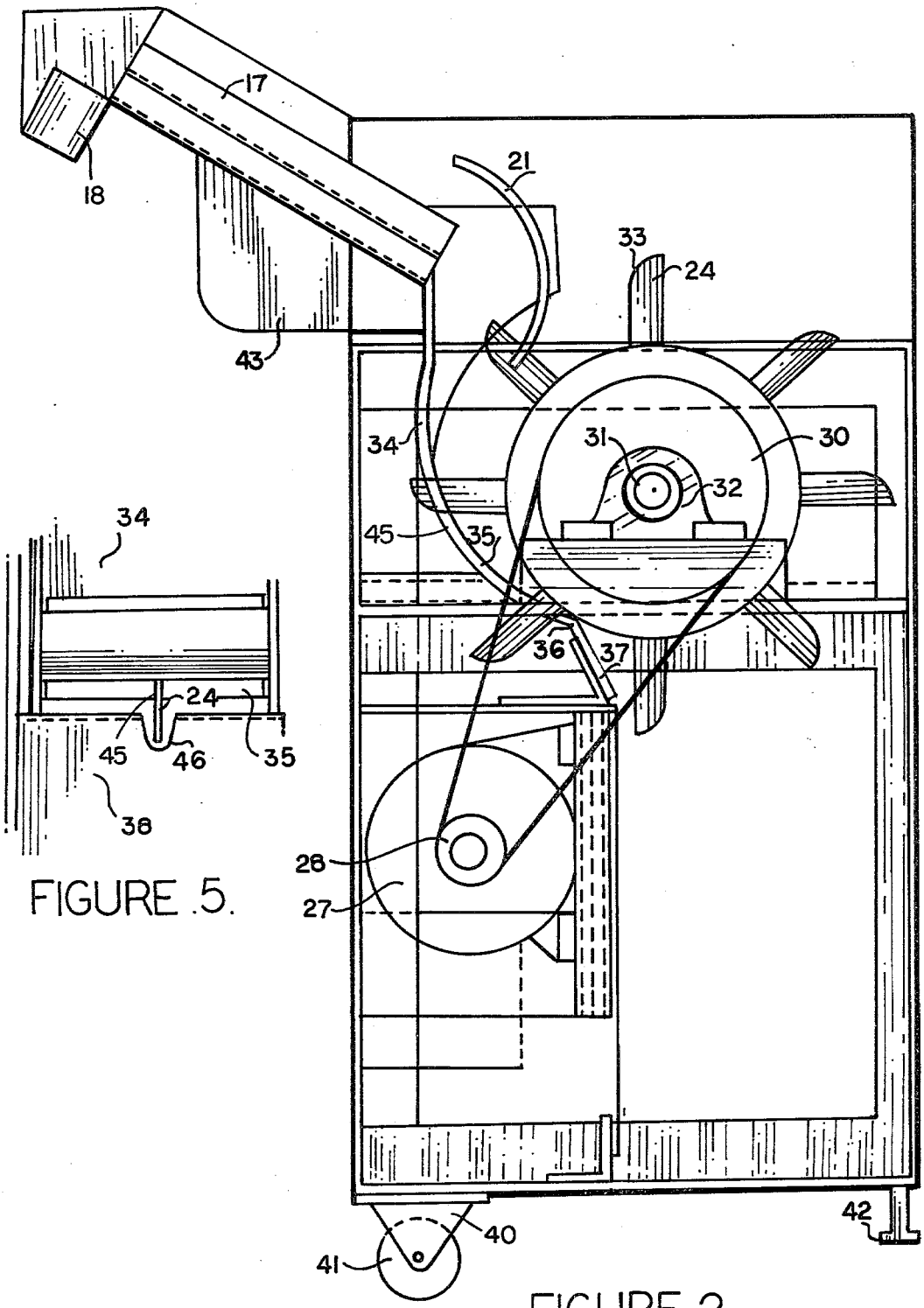
FIG. 2 is a front sectional view of the can disintegrator of FIG. 1 illustrating its operation.
FIG. 5 is a fragmentary sectional view of the fixed compacting surface having a slot therein.

Referring now to the drawings, and especially to FIGS. 1 and 2, a can disintegrating apparatus 10 is shown having a casing 11 attached to a framework 12 and having a cover 13 having a cover support bracket 14 and a friction supporting rod 15 for holding the cover hinged up on the hinge 16 for repair or examination. The cover is normally closed when the machine is operated. A can chute 17 has a ferrous can detector 18 which may be a large magnet for preventing the dropping of ferrous cans into the disintegrator to thereby maintain only scrap aluminum for resale and recycling. A can 20 fed on the chute 17 passes under guard rails 21. A rotating drum 22 has annular sides 23 and a plurality of chopping blades 24, each blade being radially extending from the drum 22 in a line around the drum 22. The drum base also has a plurality of cleats 25 on the bottom thereof, and is power driven by a chain 26 operated by an electric motor 27 such as a ½ horsepower 110 volt AC motor driving a first sprocket 28 which drives a second sprocket 30 to drive the drum 22 which is mounted to a shaft 31 riding in journals 32, which are mounted to the framework of the machine. The blades 24 may be fairly blunt blades with a curved cutting edge 33 and will engage the can 20 with great force as it passes under the protective grill 21 and falls onto a guide and compacting surface 34. The compacting surface 34 may have a slot shape to allow the blades 24 to pass through. The arcuate compacting portion 35 is a continuation of the guide 34 and both have a single continuous slot therein to allow the passage of the single row of radially extending blades 24 without letting a portion of the can pass therethrough. The can, after being cut by the blades 24, is driven with the cleats 25, as well as the blades 24 on the drum 22 to compress the can portion between the base of the drum 22 and the arcuate fixed compacting surface 35 to compress the can until it passes through the narrowed portion 36 assuring it of being compacted flat enough to pass through the space 36, where it is allowed to slide down a guide surface 37 into a receptacle 38 where a large number of aluminum cans can be stored for recycling because of the compactness of the cut and compacted aluminum cans. The compactor may have wheel brackets 40 and wheels 41 on one side and supporting feet 42 on the other, so that the unit can be easily moved from one place to another, and the chute 17 may have a protruding chute support 43 along with side rail supports 44 giving additional support to the chute and guiding the cans into the disintegrating mechanism.

Figure 3:
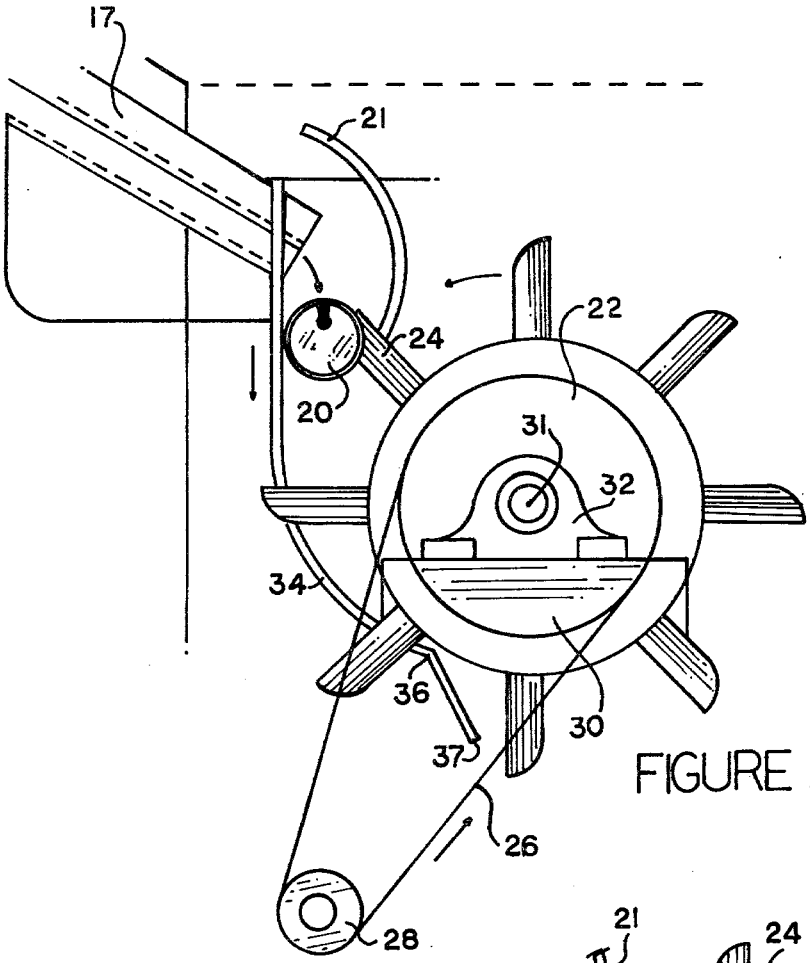
FIG. 3 is a fragmentary sectional view showing the operation of the crushing and compacting mechanism having a can in one position.
Figure 4:
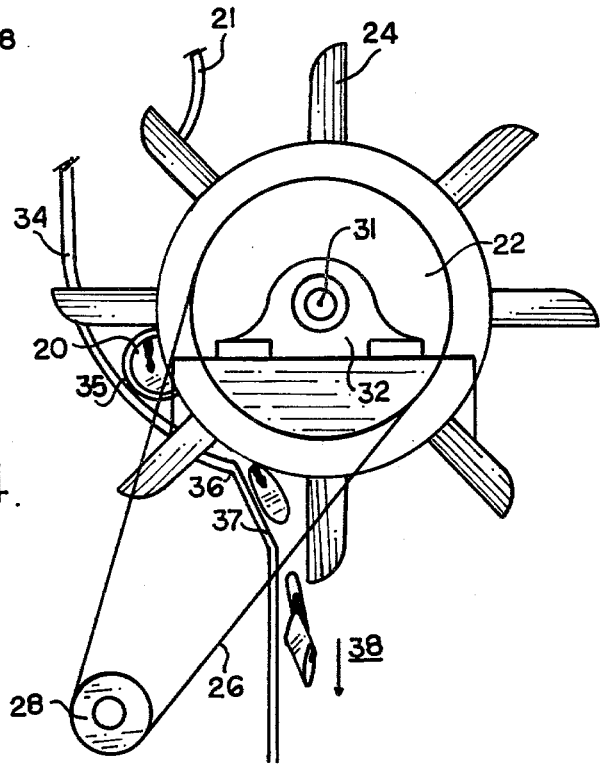
FIG. 4 is a fragmentary sectional view of the cutting and compacting mechanism having cans in different positions

The operation of disintegrating and compacting may be understood in connection with FIGS. 3 and 4 in which FIG. 3 has a can 20 leaving the chute 17 and being engaged by the first blade 24 as it passes under the grid 21. The drum 22 continues to rotate at a constant speed with a high torque motor driving the sprocket 28, which sprocket is small, relative to the sprocket 30 being driven by the chain 26, so that the speed of the drum is reduced, but the torque is increased. As the can continues down the guide surface 34 it reaches the compacting portion 35 where it is being crushed, as seen in FIG. 4, after having been chopped into two pieces. The can continues to be compacted until it passes the opening 36 where it falls along the guide surface 37 into the receptacle 38.

Figure 6:
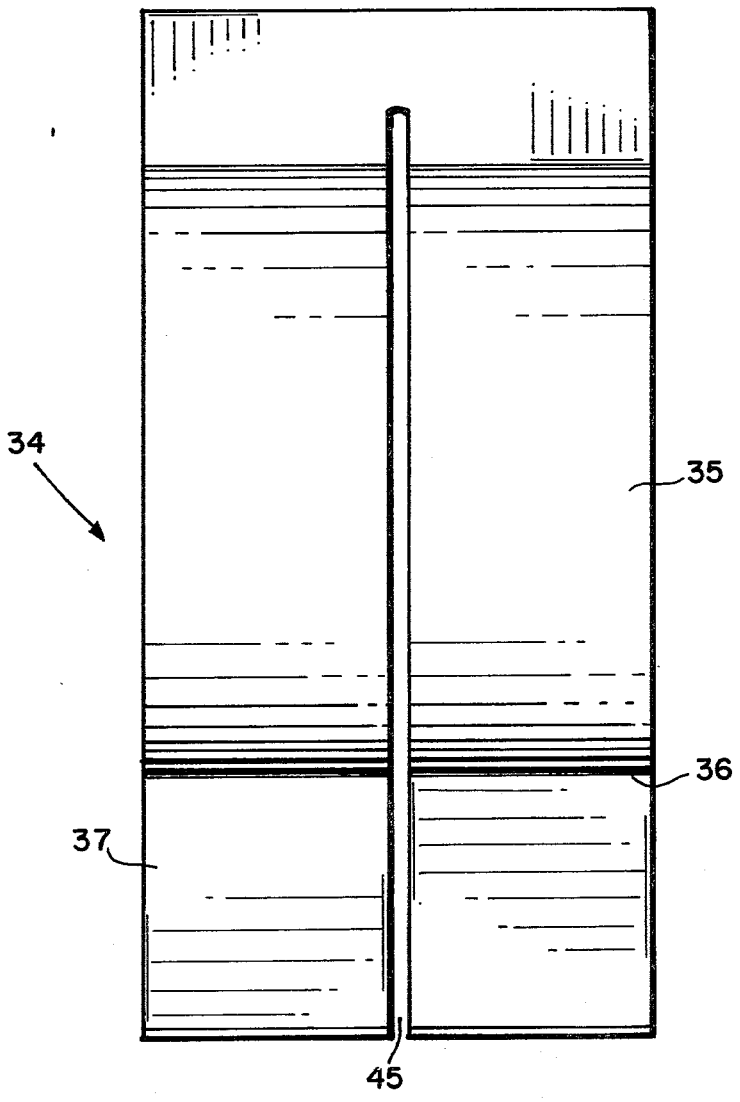
FIG. 6 is a front elevation of the fixed, compacting surface having a slot therein.

FIGS. 5 and 6 show the arcuate guide and compacting surface 34 and its guide portion 35 emptying into a receptacle 38 and having a slot 45 therein for the passage of a blade 24, and also shows the receptacle 38 having a slot 46 therein for the passage of the blade 24, so that the compacting and cutting can be done with a single rotating drum without letting portions of the cans escape or having two separate powered operations.

The method allows cans to be slid on a chute 17 into a cutting operation, cut by blades 24, followed by a compacting operation between the drum 22 and the fixed compacting surface 35, and then to be driven into a receptacle 38.

It should be clear at this point that an aluminum can disintegrator has been provided which advantageously chops and crushes the aluminum cans in a simple, compact mechanism, but it will also be clear that the mechanism can be utilized for separating out ferrous metal cans or glass bottles. The present invention is not to be constructed as limited to the particular forms disclosed herein, which are to be regarded as illustrative rather than restrictive.

I claim:

1. A can disintegrator apparatus comprising in combination:

a frame;

feed means chute for feeding cans, said feed means chute being attached to said frame;

cutting means attached to said frame for cutting a can into a plurality of pieces;

said cutting means having a plurality of cutting blades attached to a rotating drum;

compacting means attached to said frame for crushing cans between two surfaces, one surface being the surface of said rotating drum having said cutting blades attached thereto;

power means for driving said cutting means and compacting means; and receptacle means for receiving said cut and crushed can pieces.

2. The apparatus in accordance with claim 1, in which said compacting means includes cleats fixedly attached to said rotating drum for driving cans against a second compacting surface.

3. The apparatus in accordance with claim 2, in which said second compacting surface is a fixed arcuate surface attached adjacent said rotating drum.

4. The apparatus in accordance with claim 3, in which said fixed, arcuate compacting surface has a slot formed therein for the passage of said cutting means cutting blades.

5. The apparatus in accordance with claim 4, in which said fixed arcuate compacting surface narrows the spacing between said rotating drum and said fixed compacting surface to a predetermined surface, thereby compacting said cans to a size to pass through the narrowed portion between said drum and said fixed compacting surface.

6. The apparatus in accordance with claim 5, in which said cutting means plurality of cutting blades extend radially on said drum in a single line, thereby requiring only one slot through said fixed compacting surface.

7. The apparatus in accordance with claim 6, in which said power means includes an electric motor driving a sprocket and chain to drive a sprocket attached to said rotating drum.

8. The apparatus in accordance with claim 7, in which said sprocket attached to said electric motor has a smaller diameter than the sprocket attached to said rotating drum to increase the torque of said rotating drum.

9. The apparatus in accordance with claim 8, in which said cutting means rotating drum has annular sides extending above the cylindrical base of the drum to maintain said cans therebetween.

10. The apparatus in accordance with claim 9, in which a safety grill is attached at the end of the feed means chute.

11. The apparatus in accordance with claim 1, in which said receptacle means is slotted for said cutting means blades to pass through the slots, whereby cut and crushed cans are collected by the receptacle while being retained from being thrown from the receptacle.

12. The apparatus in accordance with claim 11, in which said frame has an outer protective casing and a plurality of wheels mounted on the base thereof for moving said casing between positions.

13. A method of disintegrating cans in a can disintegrator having a frame, rotating drum mounted thereto rotated by an electric motor, the drum having a plurality of blades mounted thereto, and forming one compressing surface adjacent a second compressing surface for compressing cans, the method comprising the steps of:

feeding the cans down a chute;

cutting said cans received from said chute with a plurality of blades on a rotating drum;

compacting said cut cans between said rotating drum and a stationary surface; and directing said cut and compacted cans into a receptacle.

14. The method in accordance with claim 13 including the step of driving said cut cans with cleats on said rotating drum.

15. The method in accordance with claim 14 in which the step of cutting said cans includes passing said blades through at least one slot in said stationary surface.

16. A can disintegrator apparatus comprising in combination:

a casing having a liftable top portion thereof;

a chute mounted to said casing for feeding cans thereinto;

a rotating drum mounted in said casing and driven by an electric motor;

plurality of cutting blades mounted to the base of said rotating drum for rotating therewith;

a plurality of cleats attached to the base of said drum for rotation therewith;

a fixed compacting surface attached in said casing and being slotted therein for the passage of said blades; and a receptacle for catching cut and compacted cans, whereby said blades on said rotating drum will cut cans fed from said chute into said casing and said cleats will feed said can pieces against said fixed compacting surface compacting said cans and feeding said cans into said receptacle.

* * * * *